US005254238A

United States Patent [19]

Ishii et al.

[11] Patent Number: 5,254,238

[45] Date of Patent: Oct. 19, 1993

[54] SURFACE TREATING SOLUTION AND SURFACE TREATING PROCESS FOR ZINC-PLATED STEEL PLATES

[75] Inventors: Hitoshi Ishii; Toshi Miyawaki, both of Hiratsuka, Japan

[73] Assignee: Nihon Parkerizing Co., Ltd., Japan

[21] Appl. No.: 645,816

[22] Filed: Jan. 25, 1991

[30] Foreign Application Priority Data

Jan. 25, 1990 [JP] Japan ..... 2-15715

[51] Int. Cl.[5] ..... C25D 5/48

[52] U.S. Cl. ..... 205/155; 205/316; 205/320; 205/333

[58] Field of Search ..... 205/152, 155, 316, 320, 205/333

[56] References Cited

U.S. PATENT DOCUMENTS 3,214,355 10/1965 Kandler ..... 205/320

4,957,594 9/1990 Yamazaki et al. ..... 205/316

FOREIGN PATENT DOCUMENTS 1521098 9/1971 Fed. Rep. of Germany .

*Primary Examiner*—John Niebling

*Assistant Examiner*—Brian M. Bolam

*Attorney, Agent, or Firm*—Ostrolenk, Faber, Gerb & Soffen

[57] ABSTRACT

A treating solution for forming a hydroxide film on each surface of zinc-plated steel plates by cathodic electrolysis is here disclosed which comprises (a) 0.2 to 50 g/l of one or more metal ions selected from the group consisting of $Mg^{2+}$, $Cr^{3+}$, $Ca^{2+}$, $Ni^{2+}$, $Co^{2+}$ and $Al^{3+}$, and (b) 0.1 to 50 g/l of one or more oxidizing agents selected from the group consisting of nitrate ions, nitrite ions, chlorate ions, bromate ions and hydrogen peroxide. A process for the surface treatment of the zinc-plated steel plates by the use of this treating solution is also disclosed.

10 Claims, No Drawings

SURFACE TREATING SOLUTION AND SURFACE TREATING PROCESS FOR ZINC-PLATED STEEL PLATES

BACKGROUND OF THE INVENTION (i) Field of the Invention

The present invention relates to a novel surface treating solution which can give excellent anticorrosion to zinc-plated steel plates which are bare or have been coated, and these steel plates are, for example, electrically zinc-plated steel plates, electrically zinc alloy-plated steel plates, melted zinc-plated steel plates, alloyed and melted zinc-plated steel plates or vapor-depositionally zinc-plated steel plates. Furthermore, the present invention relates to a surface treating process for zinc-plated steel plates.

(ii) Description of the Prior Art

It is known that various chromate treatments and metal flash treatments of nickel, magnesium and the like have been heretofore used in order to chemically improve the anticorrosion properties of zinc-plated steel plates. Known examples of the above-mentioned chromate treatments include a reaction type chromate treatment, a coating type chromate treatment and an electrolysis type chromate treatment. Furthermore, a known example of the metal flash treatment is the electrolytic deposition treatment of metallic nickel from an acidic nickel plating solution, as described in, for example, Japanese Patent Laid-open No. 56-55592. These treatments are mainly used as undercoating treatments.

However, in the above-mentioned chromate treatments, hexavalent chromium is used as an essential component to obtain good performance. The employment of hexavalent chromium, which is harmful and difficult of disposal, leads to an environmental problem.

When the final treatment for the zinc-plated steel plates is carried out by the above-mentioned metal flash treatment using a metal such as copper, nickel or cobalt which is nobler than zinc, the corrosion of zinc is inversely accelerated unpreferably by a local polarization function with the zinc material.

Therefore, the conventional examples can provide good anticorrosion properties but involve the environmental problem of a waste solution owing to the employment of hexavalent chromium. In addition, it is known that a metal such as aluminum or magnesium contributes to the improvement of anticorrosion properties of zinc, but the process for depositing the metal on the zinc-plated steel plates from an aqueous solution has some problems to be solved.

SUMMARY OF THE INVENTION

The present invention intends to solve the above-mentioned problems of conventional techniques, and it is directed to a treating solution for forming a hydroxide film on each surface of zinc-plated steel plates by cathodic electrolysis which comprises (a) 0.2 to 50 g/l of one or more metal ions selected from the group consisting of $Mg^{2+}$, $Cr^{3+}$, $Ca^{2+}$, $Ni^{2+}$, $Co^{2+}$ and $Al^{3+}$, and (b) 0.1 to 50 g/l of one or more oxidizing agents selected from the group consisting of nitrate ions, nitrite ions, chlorate ions, bromate ions and hydrogen peroxide. When the zinc-plated steel plates are treated by the use of this treating solution, the hydroxide film of the selected metal can be deposited on each surface of the steel plates, and this hydroxide film comprises one or more metals selected from the group consisting of Mg, Cr, Ni, Co and Al and thus it is excellent in anticorrosion.

Furthermore, the present invention is also directed to a process for the surface treatment of zinc-plated steel plates which comprises the step of carrying out cathodic electrolysis in a treating solution comprising (a) 0.2 to 50 g/l of one or more metal ions selected from the group consisting of $Mg^{2+}$, $Cr^{3+}$, $Ca^{2+}$, $Ni^{2+}$, $Co^{2+}$ and $Al^{3+}$, and (b) 0.1 to 50 g/l of one or more oxidizing agents selected from the group consisting of nitrate ions, nitrite ions, chlorate ions, bromate ions and hydrogen peroxide, under conditions of current density=0.5–50 A/dm$^2$, electrical conduction time=1–60 seconds and the total quantity of electricity=2.5–250 coulomb/dm$^2$ in order to deposit a film containing one or more selected from hydroxides of Mg, Cr, Ca, Ni, Co and Al on each surface of the zinc-plated steel plates. In particular, the electrolysis process in which each zinc-plated steel plate is used as the cathode is effective to deposit the film. Another treatment process is also acceptable in which the treating solution is brought into contact with the surfaces of the zinc-plated steel plates by spray or immersion. Moreover, after the treatment of the present invention, if necessary, it is possible to additionally subject the zinc-plated steel plates to a phosphate treatment which can also be applied as an undercoating treatment.

DETAILED DESCRIPTION OF THE INVENTION

The composition of a treating solution according to the present invention will be described in detail.

In the treating solution of the present invention, one or more metal ions selected from the group consisting of $Mg^{2+}$, $Cr^{3+}$, $Ca^{2+}$, $Ni^{2+}$, $Co^{2+}$ and $Al^{3+}$ are contained, and it is necessary that the amount of the metal ions is 0.2–50 g/l in all. When the amount of the metal ions is less than 0.2 g/l, the amount of the deposited metal hydroxide is insufficient, and conversely when it is more than 50 g/l, the deposition efficiency of the metal hydroxide cannot be improved and the use of such an excessive amount is economically disadvantageous. In the treating solution of the present invention, an oxidizing agent is also used, and the oxidizing agent is one or more ions selected from the group consisting of nitrate ions, nitrite ions, chlorate ions, bromate ions and hydrogen peroxide. It is necessary that the amount of the oxidizing agent is 0.1–50 g/l. When the amount of the oxidizing agent is less than 0.1 g/l, the deposition efficiency of the metal oxide per unit quantity of electricity deteriorates, and in the case that the film containing metal ions of $Ni^{2+}$ and $Co^{2+}$ is deposited, these ions separate out in the state of metals, with the result that anticorrosion property declines. When the amount is in excess of 50 g/l, the deposition efficiency of the metal hydroxide cannot be improved and the use of such an excessive amount is economically disadvantageous, as in the case of the above-mentioned concentration of the metal ions. These metal ions can be added in the form of a sulfate, a chloride or a nitrate, and the oxidizing agent can be added in the form of a sodium salt, an ammonium salt or a corresponding metal salt. In addition, a treatment temperature is in the range of from ordinary temperature to 70° C., and in this temperature range, the treatment can be achieved without any trouble.

The film on each surface of the zinc-plated steel plates which have been subjected to the surface treatment is composed of the hydroxides of one or more metals selected from the group consisting of Mg, Cr, Ca, Ni, Co and Al. In the course of the electrolysis treatment, if the concentrations of the metal ions and the oxidizing agent in the treating solution and the electrical conduction time, the current density and the quantity of electricity are lower than the respective predetermined levels, the amount of the deposited metal hydroxides is insufficient, so that the anticorrosion effect falls off. Furthermore, in the case that the concentrations of the metal ions and oxidizing agent as well as the electrical conduction time, the current density and the quantity of electricity are increased, the amount of the deposited metal hydroxides increases. In this case, however, the crystallinity of the deposited metal hydroxides is poor and the adhesive properties between the metal hydroxides are not so strong, so that the metal hydroxides which are precipitated/deposited in an amount in excess of a certain level are peeled and dispersed in the treating solution simultaneously at the end of the electrical conduction.

The desirable treating process is to carry out electrolysis in the above-mentioned surface treating solution by the use of each zinc-plated steel plate as the cathode under conditions of a current density of 0.5–50 A/dm$^2$, an electric conduction time of 1–60 seconds and an electricity quantity of 1–50 coulomb/dm$^2$. In addition, the surface treatment film of the present invention can be obtained by an immersion process or a spray process without any electrolysis. In the case of the electrolysis process, if the current density, the conduction time and the quantity of electricity are less than 0.5 A/dm$^2$, second and 1 coulomb/dm$^2$, respectively, the amount of the deposited film is insufficient, with the result that enough anticorrosion cannot be obtained. Moreover, if the current density, the conduction time and the quantity of electricity are more than 50 A/dm$^2$, 60 seconds and 50 coulomb/dm$^2$, respectively, the amount of the deposited metal hydroxides does not increase for the above-mentioned reason, so that the improvement of the anticorrosion property cannot be expected any more. In the electrolysis treatment, examples of the usable anode include insoluble electrodes such as a platinum electrode and a lead electrode and soluble electrodes comprising these metals or alloys containing these metals.

Next, the mechanism of the film according to the present invention will be described. When each zinc-plated steel is used as a cathode in the treating solution of the present invention and current is caused to flow, hydrogen ions are consumed on the surface of the cathode owing to the decomposition of the oxidizing agent, and as a result, a pH rises [→(1), (2), (3), (4) and (5)].

$$NO_3^- + 7H_2O + 8e^- \rightarrow NH_4^+ + 10OH^- \quad (1)$$

$$NO_2^- + 6H_2O + 6e^- \rightarrow NH_4^+ + 8OH^- \quad )2)$$

$$ClO_3^- + 3H_2O + 6e^- \rightarrow Cl^- + 6OH^- \quad (3)$$

$$BrO_3^- + 3H_2O + 6e^- \rightarrow Br^- + 6OH^- \quad (4)$$

$$H_2O_2 + 2e^- \rightarrow 2OH^- \quad (5)$$

In consequence, metal ions which are dissolved in the treating solution are precipitated in the form of hydroxides, and in this case, they are deposited on the surface of the steel plate [(1), (2), (3), (4), (5) and (6)].

$$Mg^{2+} + 2OH^- \rightarrow Mg(OH)_2 \downarrow \quad (1)$$

$$Cr^{3+} + 3OH^- \rightarrow Cr(OH)_3 \downarrow \quad (2)$$

$$Ca^{2+} + 2OH^- \rightarrow Ca(OH)_2 \downarrow \quad (3)$$

$$Ni^{2+} + 2OH^- \rightarrow Ni(OH)_2 \downarrow \quad (4)$$

$$Co^{2+} + 2OH^- \rightarrow Co(OH)_2 \downarrow \quad (5)$$

$$Al^{3+} + 3OH^- \rightarrow Al(OH)_3 \downarrow \quad (6)$$

Here, the functional effect of the deposited metal hydroxides on the zinc-plated steel plate will be described.

In the case that zinc is corroded under wet corrosive circumstances containing chlorine, the main component of the rust is zinc oxide, and since this zinc oxide imparts no anticorrosive function to zinc, the corrosion makes rapid progress. However, if metal ions such as $Mg^{2+}$, $Cr^{3+}$, $Ca^{2+}$, $Ni^{2+}$, $Co^{2+}$ and $Al^{3+}$ are present in the above-mentioned corrosive circumstances, the formation of zinc oxide can be inhibited, and basic zinc chloride is instead selectively produced. This basic zinc chloride, in contrast to zinc oxide, has good adhesive properties to the zinc material and a low electrical conductivity, and so it is known that basic zinc chloride is excellent in anticorrosive function to the zinc material.

In other words, the function of the metal hydroxide film in the present invention would be that the metallic components melted out at the time of the corrosion act on the zinc material, which leads to the increase of the formation of basic zinc chloride having the anticorrosive effect to the corrosion of the zinc material.

Now, the present invention will be described in detail in reference to Examples 1 to 7 and Comparative Examples 1 to 4.

Test Pieces

In all the experiments, steel plates were used which had a unit weight of 20 g/m$^2$ and which had been electroplated with zinc on both the surfaces thereof.

Procedure of Treatment (1) Degreasing: 42° C., 120 seconds, Spray FC-L4460 (Japanese Parkerizing Co., Ltd.) 20 g/l of Agent A, 12 g/l of Agent B
(2) Water washing: Tap water, Room temperature, 20 seconds, Spray
(3) Treatments in examples and comparative examples (temperature=40° C., anode for electrolysis treatment=platinum electrode)
(4) Water washing: Tap water, Room temperature, 20 seconds, Spray
(5) Drying: 110° C., 180 seconds

Evaluation of Performance

The edge portions of the plated steel plates were sealed, and a saline solution spray test was carried out in order to measure each generation time of red rust.

TABLE 1

| Evaluation Rank of Anticorrosion Effect by Saline Solution Spray Test (generation time of red rust) | |
|---|---|
| Grade | Generation Time of Red Rust |
| ◎ | 121 hours or more |

TABLE 1-continued

| Evaluation Rank of Anticorrosion Effect by Saline Solution Spray Test (generation time of red rust) | |
|---|---|
| Grade | Generation Time of Red Rust |
| ○ | 73–120 hours |
| Δ | 48–72 hours |
| X | less than 48 hours |

Table 2 shows the treatment conditions and the anticorrosion effects of examples and comparative examples except for Comparative Example 4.

All the metal ions in Table 2 were added in the form of sulfates, and oxidizing agents were added in the form of a 31% aqueous solution in the case of hydrogen peroxide and in the form of sodium salts in the other cases.

selected from the group consisting of $Mg^{2+}$, $Cr^{3+}$, $Ca^{2+}$, $Ni^{2+}$, $Co^{2+}$ and $Al^{3+}$ and a predetermined amount of an oxidizing agent of nitrate ions or the like, and therefore the treating solution can exert good effects such as the formation of a film having excellent anticorrosion and no environmental problem of a waste solution treatment. Furthermore, the present invention uses the above-mentioned specific surface treating solution and preferably each zinc-plated steel plate as a cathode and specifies a current density and the total quantity of electricity, and therefore the film of metal hydroxides can be deposited effectively on the zinc-plated steel plates.

In addition, in contrast to the upper layer of a conventional two-layer plate, the formed film of the metal hydroxides can exhibit a sufficient effect in a small deposition amount, which can decrease costs remarkably.

TABLE 2

| | Metal Ions | Oxidizing Agent | pH | Current Density ($A/dm^2$) | Conduction Time (sec) | Quantity of Electricity ($coulomb/dm^2$) | Anticorrosive Properties |
|---|---|---|---|---|---|---|---|
| Example 1 | $Mg^{2+}$ = 0.3 g/l | $NO_3^-$ = 0.5 g/l | 7.0 | 50 | 5.0 | 250 | ◎ |
| Example 2 | $Cr^{3+}$ = 1.0 g/l<br>$Co^{2+}$ = 0.5 g/l | ClO3 = 0.3 g/l<br>$H_2O_2$ = 0.1 g/l | 4.0 | 0.6 | 60 | 36 | ◎ |
| Example 3 | $Ni^{2+}$ = 1.0 g/l<br>$Al^{3+}$ = 2.0 g/l | $BrO3^-$ = 0.1 g/l<br>$NO2^-$ = 0.2 g/l | 3.0 | 0.6 | 4.5 | 2.7 | ○ |
| Example 4 | $Mg^{2+}$ = 3.0 g/l<br>$Ca^{2+}$ = 1.0 g/l | $ClO_3^-$ = 0.3 g/l | 8.0 | 20 | 1.1 | 22 | ◎ |
| Example 5 | $Cr^{3+}$ = 30 g/l<br>$Al^{3+}$ = 10 g/l | $NO_2^-$ = 0.12 g/l | 3.0 | 5.5 | 6.0 | 33 | ◎ |
| Example 6 | $Ni^{2+}$ = 1.0 g/l<br>$Cr^{3+}$ = 2.0 g/l | $NO_3^-$ = 45 g/l | 4.5 | 7.0 | 2.0 | 14 | ◎ |
| Example 7 | $Cr^{3+}$ = 2.0 g/l | $NO_3^-$ = 5 g/l | 4.5 | 3.0 | 3.0 | 9.0 | ◎ |
| Comp. Ex. 1 | $Mg^{2+}$ = 0.15 g/l | $NO_3^-$ = 0.5 g/l | 7.0 | 0.6 | 0.8 | 0.48 | X |
| Comp. Ex. 2 | $Mg^{2+}$ = 3.0 g/l<br>$Ca^{2+}$ = 1.0 g/l | $ClO_3^-$ = 0.3 g/l | 8.0 | 0.4 | 6.0 | 2.4 | X |
| Comp. Ex. 3 | $Ni^{2+}$ = 1.0 g/l<br>$Cr^{3+}$ = 2.0 g/l | $NO_3^-$ = 0.08 g/l | 4.5 | 7.0 | 2.0 | 14 | X |

COMPARATIVE EXAMPLE 4

A plating bath comprising

Nickel sulfate: 300 g/l

Nickel chloride: 45 g/l

Boric acid: 35 g/l was used, and electroplating was carried out under conditions of a bath temperature=50° C. and a current density=5 $A/dm^2$ so as to form a nickel film having a thickness of 0.01 micron (Japanese Patent Laid-open No. 56-55592).

The grade of anticorrosion was X.

Reference will be made to examples and comparative examples shown in Table 2. In the first place, with regard to the concentration of metal ions in the treating solution, its lower limit was set to 0.2 g/l in view of Example 1 (0.3 g/l) and Comparative Example 1 (0.15 g/l). With regard to the concentration of the oxidizing agent in the treating solution, its lower limit was set to 0.1 g/l in view of Example 5 (0.12 g/l) and Comparative Example 3 (0.08 g/l). In a treating procedure, the lower limit of a current density was set to 0.5 $A/dm^2$ in view of Example 2 (0.6 $A/dm^2$) and Comparative Example 2 (0.4 $A/dm^2$), the lower limit of a conduction time was set to 1.0 second in view of Example 4 (1.1 seconds) and Comparative Example 1 (0.8 second), and the lower limit of the quantity of electricity was set to 2.5 $coulomb/dm^2$ in view of Example 3 (2.7 $coulomb/dm^2$) and Comparative Example 2 (2.4 $coulomb/dm^2$).

As discussed above, a surface treating solution for zinc-plated steel plates of the present invention contains a predetermined amount of one or more metal ions Moreover, after the treatment, a phosphorate treatment can be additionally carried out so as to improve coating performance.

What is claimed is:

1. A treating solution for forming a hydroxide film by carrying out cathodic electrolysis on each surface of zinc-plated steel plates which consists essentially of water and (a) 0.2 to 50 g/l of one or more metal ions selected from the group consisting of $Mg^{2+}$, $Cr^{3+}$, $Ca^{2+}$, $Ni^{2+}$, $Co^{2+}$, and $Al^{3+}$, and (b) 0.1 to 50 g/l of one or more oxidizing agents selected from the group consisting of nitrate ions, nitrite ions, chlorate ions, bromate ions and hydrogen peroxide.

2. A treating solution according to claim 1 containing 0.3 to 40 g/l of said metal ions and 0.12 to 45 g/l of said oxidizing agent.

3. A treating solution according to claim 2 containing 1.5 to 4 g/l of said metal ions and 0.3 to 5 g/l of said oxidizing agents.

4. A treating solution according to claim 1 containing more than one of said metal ions.

5. A treating solution according to claim 1 containing more than one of said oxidizing agents.

6. A process for the surface treatment of zinc-plated steel plates which comprises the step of carrying out cathodic electrolysis in a treating solution consisting essentially of water and (a) 0.2 to 50 g/l of one or more metal ions selected from the group consisting of $Mg^{2+}$, $Cr^{3+}$, $Ca^{2+}$, $Ni^{2+}$, $Co^{2+}$ and $Al^{3+}$, and (b) 0.1 to 50 g/l of one or more oxidizing agents selected from the group consisting of nitrate ions, nitrite ions, chlorate ions, bromate ions and hydrogen peroxide, under conditions of current density=0.5-50 A/dm$^2$, electrical conduction time=1.1-60 seconds and the total quantity of electricity=2.5-250 coulomb/dm$^2$ in order to deposit a film containing one or more selected from hydroxides of Mg, Cr, Ca, Ni, Co and Al on each surface of the zinc-plated steel plates.

7. A process according to claim 6 in which said treating solution contains 0.3 to 40 g/l of said metal ions and 0.12 to 45 g/l of said oxidizing agent.

8. A process according to claim 7 in which said treating solution contains 1.5 to 4 g/l of said metal ions and 0.3 to 5 g/l of said oxidizing agents.

9. A process according to claim 6 in which said treating solution contains more than one of said metal ions.

10. A process according to claim 6 in which said treating solution contains more than one of said oxidizing agents.

* * * * *